United States Patent [19]

Bernardi

[11] 4,287,637

[45] Sep. 8, 1981

[54] TRASH BAG ENCLOSURE

[76] Inventor: William A. Bernardi, 97 River St., Norwell, Mass. 02061

[21] Appl. No.: 90,120

[22] Filed: Nov. 1, 1979

[51] Int. Cl.[3] ..... E04H 17/00

[52] U.S. Cl. ..... 256/1; 256/25

[58] Field of Search ..... 256/24, 25, 1, 12, 5; 47/28, 30, 26; 53/399

[56] References Cited

U.S. PATENT DOCUMENTS

| | | | |
|---|---|---|---|
| 1,060,116 | 4/1913 | Oters | 47/30 |
| 1,641,244 | 9/1927 | Woodruff | 47/28 |
| 2,208,458 | 7/1940 | Julian et al. | 256/25 UX |
| 2,997,277 | 8/1961 | Schwartz | 256/24 |
| 3,218,759 | 11/1965 | Barrons | 47/30 |
| 3,537,688 | 11/1970 | Stein | 256/24 |
| 3,709,237 | 1/1973 | Smith | 256/25 X |
| 3,880,404 | 4/1975 | Fitch | 256/1 |
| 3,924,913 | 12/1975 | Cooper | 47/26 X |
| 4,124,196 | 11/1978 | Hipskind | 256/1 |

*Primary Examiner*—Andrew V. Kundrat

*Attorney, Agent, or Firm*—Kenway & Jenney

[57] ABSTRACT

A collapsible trash bag enclosure is formed from a plastic sheet set to have a rolled up configuration and unwindable to enclose and grip trash bags within it. A tubular section at one end slips over a rod driven into the ground to fix the enclosure to the ground. Slots in the sheet reduce wind resistance and allow the insertion of clips to clip together overlapping portions of the sheet.

7 Claims, 5 Drawing Figures

TRASH BAG ENCLOSURE

BACKGROUND OF THE INVENTION

The invention relates generally to trash bag enclosures and particularly to such enclosures that are collapsible and portable.

The use of lightweight plastic bags to store trash and rubbish so that the trash and rubbish can be brought to curb side for pick-up has become prevalent. The bags are handy containers and are relatively manageable. They are complete containers and are removed completely by those assigned to pick them up, leaving the curb-side subsequent to pick up absolutely clear. They are easily handled by those assigned to pick them up; some communities even require that trash put out at curb-side be placed in plastic bags.

There are however disadvantages to the use of plastic bags for holding trash, based primarily on the bags not being rigid, strong containers. They are easily torn. Accordingly, stray pets, mischievous children, careless pedestrians and even strong winds can cause a plastic trash bag to break and spill its contents.

A rigid container to hold plastic trash bags to prevent spillage would defeat the very purpose for which the plastic bags are used in the first place. Such containers are heavy and less manageable than plastic bags. Their capacity is limited to holding only one or two bags. And when the bags are removed from a container during trash pick-up, the container, usually an unsightly one, remains behind until it is removed by the owner.

Accordingly, it is an object of this invention to provide a portable, lightweight, attractive, inexpensive, large capacity container for plastic trash bags. It is another object to provide a container for such bags that is adjustable to the number of bags that need to be enclosed. It is also an object to provide such a container that may be easily fixed to and removed from a set location. A further object is to provide such a container that is easy to manufacture, use and store.

SUMMARY OF THE INVENTION

A trash bag enclosure comprises a sheet substantially rigid in the vertical direction and resiliently windable about a central vertical axis, the sheet being biased to assume a rolled up configuration about the axis. The sheet is unwindable to encircle and grip trash bags with its concave surface, thereby providing an expandible and collapsible container for trash bags.

In a preferred embodiment, the enclosure is made of pre-set plastic, has an end that may be secured to a fixed location, and has a plurality of openings to reduce wind resistance, that may be aligned in the horizontal direction so that they overlap when portions of the sheet overlap and the overlapping portions may be clipped together.

BRIEF DESCRIPTION OF THE DRAWING

Other objects, features and advantages of the invention will be described or be apparent from the following description of a preferred embodiment, and the drawing thereof, in which.

DESCRIPTION OF A PREFERRED EMBODIMENT

Figure 1:
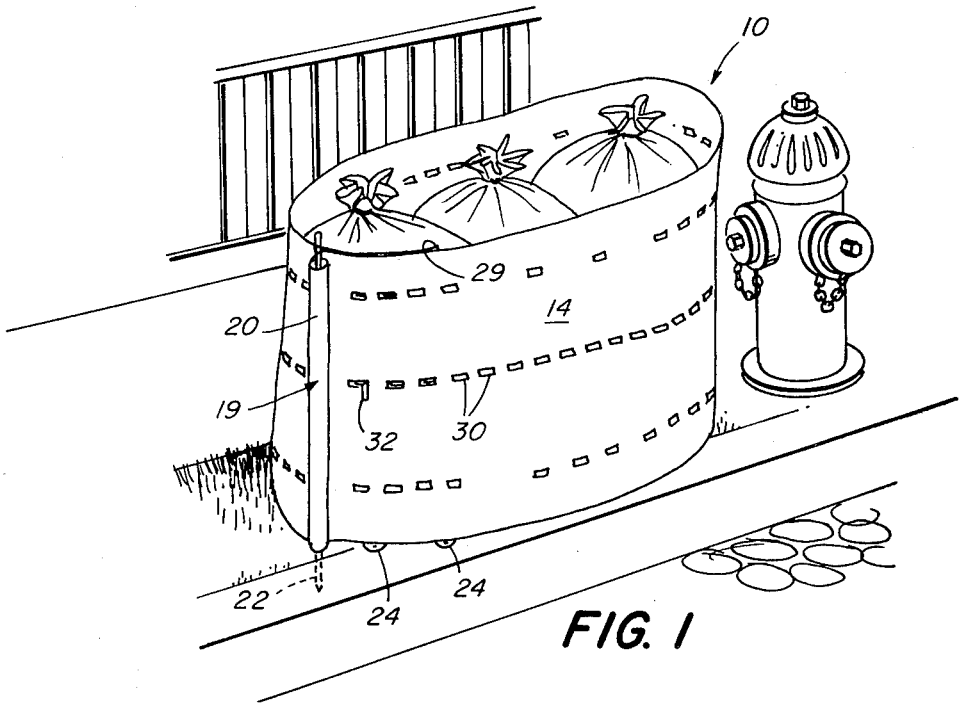
FIG. 1 is a perspective view of a trash bag enclosure according to the invention.
Figure 2:
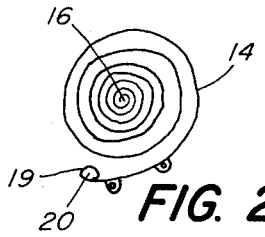
FIG. 2 is a plan view of the enclosure in its rolled up form.
Figure 3:
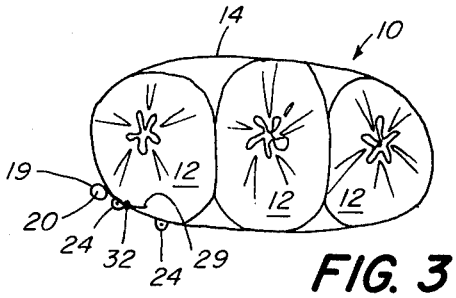
FIG. 3 is a plan view of the enclosure with bags of trash enclosed.

FIG. 1 shows a trash bag enclosure 10 enclosing three plastic trash bags 12 at curb-side on a sidewalk. The enclosure 10 includes a plastic sheet 14 that is about four feet high, high enough to conceal the trash bags 12 but low enough to allow access to the bags for removing them from the enclosure when trash is picked up. The plastic sheet 14 is set so that it is biased to assume a rolled up configuration, like that shown in FIG. 2, about a central vertical axis 16 in the absence of any articles within the enclosure 10. The sheet 14 is resilient, so that it may be unwound from its rolled up configuration and wrapped around a group of trash bags 12, as shown in FIG. 3, encircling and gripping the bags 12 with its inside concave surface 18 as it seeks to restore itself to its rolled up configuration. The sheet 14 is substantially rigid in its vertical direction—that is, it will maintain its vertical shape and stiffness by itself. The length of the sheet 14 is selected so that the enclosure 10 may enclose several trash bags 12. A length of about twelve feet would provide an enclosure 10 of about four feet in diameter.

The sheet 14 terminates at one end 19 in a tubular section 20 formed from the same material as the sheet, preferably in the same operation that produced that sheet 14. The tubular section 20 extends vertically at one end of the sheet 14, and, as seen in FIG. 1, is slipped over a vertical rod 22 fixed into the ground. Thus one end of the enclosure 10 is firmly fixed to the ground so that it cannot be blown loose or shaken or pushed over.

Figure 4:
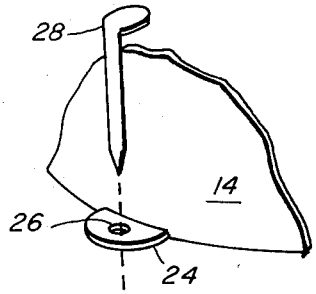
FIG. 4 is a detailed perspective view of a tab at the bottom of the enclosure of FIG. 1.

To further affix the enclosure 10 to the ground, the sheet 14 has tabs 24 projecting outwardly at ground level from the bottom of the sheet. The tabs 24 have holes 26 through which spikes 28 are driven into the ground as shown in FIG. 4, to fix the enclosure 10 even more firmly to its location. Since the tabs 24 are located near the fixed end 19 of the sheet 10, they do not interfere with the movement of the free end 29 of the sheet.

Figure 5:
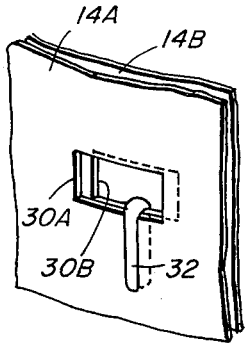
FIG. 5 is a detailed perspective view of the enclosure, showing overlapping slots of the enclosure and a clip used in conjunction with the slots.

The sheet 10 has a plurality of slots 30 in the sheet 14. The slots 30 are arranged in horizontal rows and are spaced close together so that as the sheet 14 encircles articles within it, and portions of the sheet 14 overlap, the slots 30 overlap too. As shown in FIG. 5 the slots 30 are large enough so that they reduce the wind resistance of the sheet 14, and allow the insertion of a clip 32. The clip 32 may be in any convenient form, including a clothespin, for example. As shown in FIG. 5, a slot 30A on an outside portion 14A of sheet 14 partially overlaps a slot 30B on an inside portion 14B of sheet 14. The clip 32 is used to clip the outside portion 14A and the inside portion 14B together, additionally securing the enclosure 10 in a closed position.

In use, the rod 22 is driven into the ground where the trash bag enclosure 10 will be used. When the trash is to be brought to curb-side, the end 19 of the enclosure with the tubular section 20 is slipped over the rod 22 and the free end 29 of the sheet 14 is unwound. The trash bags 12 are placed within the unwound sheet 14 and the free end 29 is released so that the sheet 14 encloses and grips the bags 12 with its inner concave surface 18. The bias of the sheet 14, pre-set to form the rolled-up configuration of FIG. 2, will cause the enclosure 10 to hold the trash bags 12 snugly in place. When the trash bags 12 are subsequently removed from the enclosure 10, the sheet 14 will resume its rolled up configuration, forming a relatively unobtrusive presence at curb-side and it may be carried away easily for storage.

Additional securing of the enclosure 10 to the ground by means of spikes 28 passing through the tabs 24 is done when conditions warrant it. Such conditions might include a desire to make the enclosure 10 a semi-permanent fixture, or a need to temporarily secure the enclosure 10 more firmly, as when high winds are expected. Ordinarily, the weight of the loaded trash bags 12 is enough to maintain the enclosure 10 in position when full. The rod 22 is enough to secure the enclosure 10 in position when the enclosure is empty and rolled up.

The slots 30 in the sheet 14 eliminate some wind resistance. They also provide, since they overlap, an opportunity to clip together outside 14A and inside 14B portions of the sheet 14 to further strengthen the enclosing strength of the enclosure 10.

The bags 12 can easily be removed from the enclosure 10 by lifting them by their tops. The clip 32 would prevent the sheet 14 from collapsing on remaining bags 12 as others are removed. Without the clip, or after the clip is removed, the sheet 14 will resume its rolled up configuration.

Modifications of the disclosed embodiment are contemplated and would be within the scope of the invention. The enclosure 10 need not be fixed to the ground, but could be secured to a building for example. The method of securing the enclosure 10 to a rod driven into the ground need not be by the tubular section illustrated, but could be by some other fastening means, such as wire loops or strings. The tabs 24 may be made large enough so that bricks, for example, could be placed on top of them to hold down the enclosure 10. This would be especially useful where the enclosure is used on a hard surface, into which spikes could not easily be driven. Thus additions, substractions, deletions and other modifications of the disclosed embodiment will be obvious to those skilled in the art and are within the scope of the following claims.

I claim:

1. A trash bag enclosure comprising:

a sheet substantially rigid in the vertical direction and resiliently windable about a central vertical axis, said sheet being biased to assume a rolled up configuration about said central axis, said sheet encircling with a concave surface of said sheet at least one loaded trash bag and being partially rewound to encircle and grip said trash bag with said concave surface in a cooperative relationship with said trash bag, said sheet having one end portion with means for securing said one end vertically to a fixed location and another end portion free to wind and unwind about said central vertical axis.

2. The trash bag enclosure as claimed in claim 1 in which said sheet defines a plurality of openings.

3. The trash bag enclosure as claimed in claim 2 in which at least a portion of said plurality of openings is aligned in the horizontal direction the portions of said sheet forming said openings being adapted to receive clipping means so that said aligned openings overlap when portions of said sheet overlap.

4. The trash bag enclosure as claimed in claim 3 including clip means to clip together overlapping portions of said sheet at overlapping openings.

5. The trash bag enclosure as claimed in claim 1 in which said sheet has one end portion having means for securing said sheet to an element driven into the ground.

6. The trash bag enclosure of claim 1 in which said sheet is plastic, said plastic sheet being set to assume said rolled up configuration.

7. A trash bag enclosure comprising:

a sheet substantially rigid in the vertical direction and resiliently windable about a central vertical axis, said sheet being biased to assume a rolled up configuration about said central axis, said sheet being unwindable to encircle with a concave surface of said sheet at least one trash bag and to grip said trash bags with said concave surface, said sheet having one end portion with means for securing said end vertically to a fixed location and another end portion free to wind and unwind about said central vertical axis, said sheet defining a plurality of openings at least a portion of which are aligned in the horizontal direction so that said aligned openings overlap when portions of said sheet overlap, and clip means to clip together overlapping portions of said sheet at overlapping openings.

* * * * *